US005857870A

United States Patent [19]

Carter

[11] Patent Number: 5,857,870

[45] **Date of Patent: *Jan. 12, 1999**

[54] ELECTRICAL CONNECTOR WITH SWITCH SUBASSEMBLY

[75] Inventor: Clyde Thomas Carter, Shermans Dale, Pa.

[73] Assignee: The Whitaker Corporation, Wilmington, Del.

Related U.S. Application Data

[60] Provisional application No. 60/009,122, Dec. 22, 1995.

[21] Appl. No.: 769,618

[22] Filed: Dec. 18, 1996

[51] Int. Cl.[6] ..... H01R 4/24

[52] U.S. Cl. ..... 439/402; 439/188; 200/51.1

[58] Field of Search ..... 439/188, 395, 439/402, 404; 200/51 R, 51.1

[56] References Cited

U.S. PATENT DOCUMENTS

| | | | |
|---|---|---|---|
| 3,501,599 | 3/1970 | Horecky | 200/16 |
| 3,976,850 | 8/1976 | Faber et al. | 200/51.1 |
| 4,356,361 | 10/1982 | Schwab | 200/16 D |
| 4,562,311 | 12/1985 | Dola | 179/158 R |
| 5,420,920 | 5/1995 | Capper et al. | 379/399 |
| 5,423,694 | 6/1995 | Jensen et al. | 439/402 X |

*Primary Examiner*—Khiem Nguyen

[57] ABSTRACT

An electrical connector (10) having a body (20), a switch assembly (30) for slideable disposition in the body (20), and discriminators (60,70,80) for terminating large and/or small gauge wires. The switch subassembly includes a conventional dummy-load test circuit. Insulation displacement contacts (40,50) are disposed in the body and in the discriminators (60,70 80) for termination with the wires. The switch assembly (20) is slidably disposed within the body (20) in a sealed cavity (27), and contacts (32) of the subassembly slidably but electrically interface with contacts (40,50), the switch assembly (20) is thereby suspended in the cavity and its motion is guided along contacts (40,50) which act as tracks as the switch assembly is displaced between normal and test mode positions.

17 Claims, 10 Drawing Sheets

ELECTRICAL CONNECTOR WITH SWITCH SUBASSEMBLY

This application claims the benefit of U.S. Provisional Application No. 60/009,122, filed Dec. 22, 1995.

The present invention relates to an electrical connector for use in testing an electrical circuit, e.g. a telecommunications circuit, the electrical connector comprising a body having electrical contacts and a cavity with a switch assembly therein.

BACKGROUND OF THE INVENTION

Telecommunications circuits entering a building in the form of a twisted pair cable are often terminated to electrical connectors in an enclosure mounted in or adjacent to the building. Such connectors are often subjected to the harsh conditions associated with use in an indoor/outdoor telecommunications environment, e.g. extremes of heat, cold, and moisture. A typical indoor/outdoor telecommunications connector, once installed, defines an interface between sub-circuit sides of the telecommunications circuit, namely, central office and subscriber side sub-circuits. Installation of the connector requires that the respective wires of the central office and subscriber sides be reliably terminated with electrical contacts in the connector. It is then necessary for the operator to test one or both of the sub-circuits. For subscriber side testing purposes a manual switching operation must be performed, i.e. the operator must disconnect the subscriber side circuit from the electrical connector, connect an electrical dummy-load across the subscriber side twisted pair, test the subscriber side circuit, and then remove the dummy-load and reconnect the subscriber side to the electrical connector. Manually switching the subscriber side to a dummy-load and back to the electrical connector is a time consuming operation. Moreover, twisted pair cables of differing nominal sizes often populate a given enclosure, and the installation operation may be further complicated because different sized connectors or adapters must be used to adapt the connection between wires and electrical connectors of differing nominal sizes.

However, prior electrical connectors comprising a switch are not suitable for use in telecommunications circuits. For example, an electrical connector incorporating a switch is disclosed in U.S. Pat. No. 4356361, which discloses a modular electrical switch for use in programming electrical equipment. The electrical connector comprises an electrically insulating housing, and a pair of elongated electrical terminals secured to the base of the housing. The switch comprises an electrically conductive contact bearing disposed within the housing which is moveable between on/off modes. The electrical terminals protrude from the bottom of the housing for being soldered to a printed circuit board, and the housing is adapted for use with dual in-line package electrical components. The known electrical connector is directed toward use with a printed circuit board for programming electronic circuits, and it is not suitable for use in indoor/outdoor telecommunications circuits. This is because the known switch is not adapted for use with twisted pair cable, and the switching configuration thereof is not adapted to disconnect one pair of wires while another pair is connected to a dummy-load. Moreover, terminations are often made in enclosures, which does not leave enough room for time consuming soldering operations Additionally, the overall structure of the known electrical connector does not admit of use in the harsh conditions associated with the indoor/outdoor telecommunications environment

SUMMARY OF THE INVENTION

In view of the foregoing, it is an object of the invention to provide an electrical connector that comprises a switching function for testing a subscriber side circuit without the need to disconnect wires from the electrical connector.

It is another object of the invention to provide an electrical connector that is suitable for use in telecommunications circuits and permits swift, reliable electrical connections It is a further object of the invention to provide an electrical connector that is robust enough for use in indoor or outdoor enclosures.

It is yet another object of the invention to provide an electrical connector that can accommodate small or large gauge wires without separate wire adapters.

In meeting the foregoing objectives, the present invention provides an electrical connector comprising a body, the body includes a wire terminating electrical contacts, cavity and a switch assembly therein, the electrical connector further comprises at least one electrical contact as part of the switch assembly. The switch assembly contact includes a sliding contact section which is interengageably received by a portion of at least one of the wire terminating electrical contacts, the switch assembly is thereby slidably supported in the cavity as the switch assembly is moved with ease between normal and test modes of the circuit without the need to disconnect wires from the electrical connector. Preferably, the electrical connector comprises at least two electrical contacts for being interengageably received by respective ones of the wire terminating electrical contacts for slidably supporting the switch assembly in the cavity between normal and test modes of the circuit.

For permitting swift, reliable electrical connections the electrical connector includes wire terminating electrical contacts comprising wire termination sections that are arranged in a superimposed relationship with respect to each other for terminating wires of different nominal sizes. Additionally, the body comprises rails that movably receive a respective set of terminating members thereon. The terminating members are operative to receive and move respective ones of the wires into electrical engagement with the wire terminating electrical contacts. The body further includes contact receiving projections that cooperate with projection receiving cavities formed on the wire terminating members for protecting the contacts from exposure to the environment and foreign objects.

DETAILED DESCRIPTION OF THE INVENTION

Figure 1:
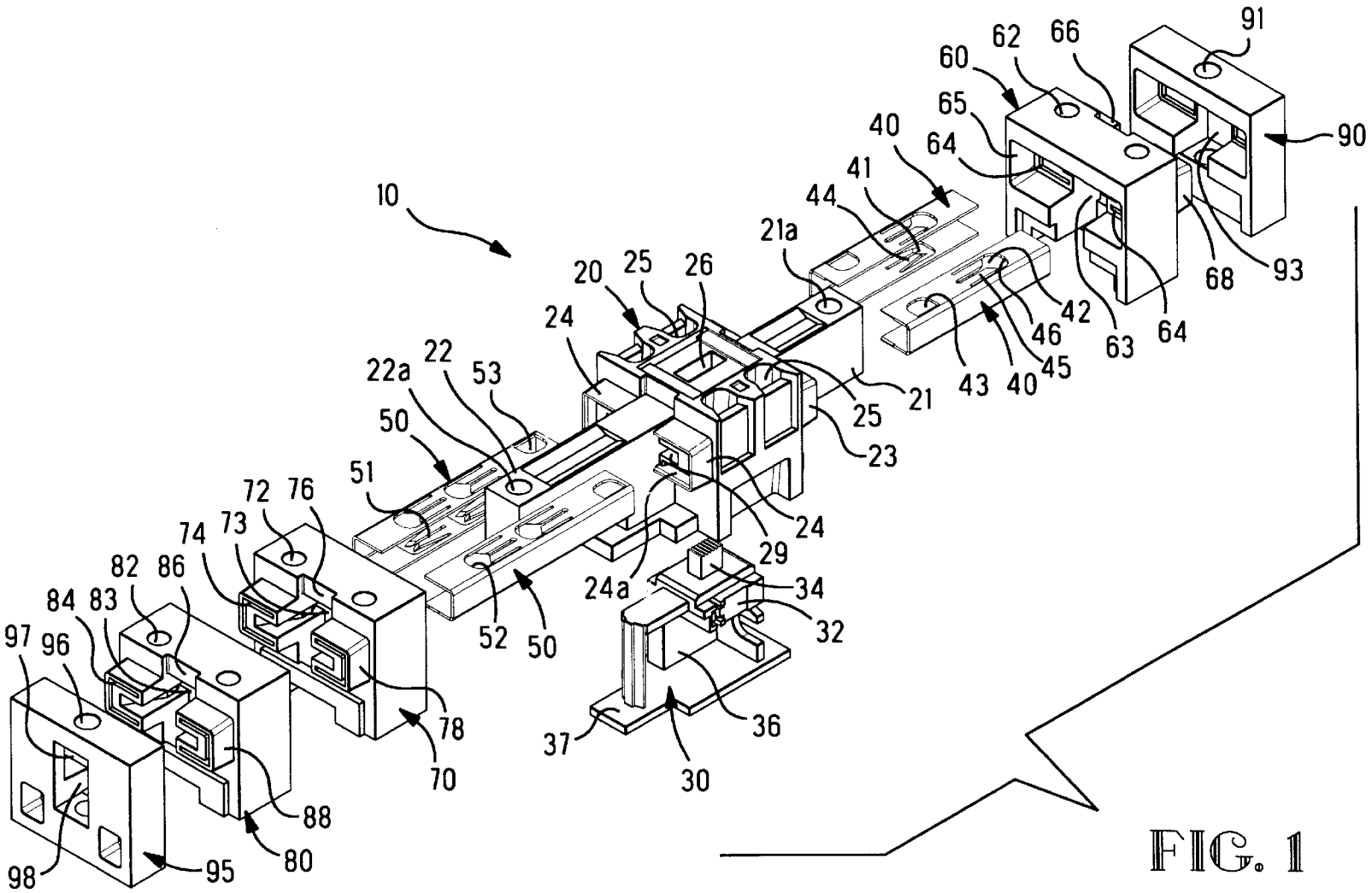
FIG. 1 shows an isometric exploded view of the electrical connector according to the present invention.

An electrical connector assembly 10 according to the present invention will now be described. As is best shown in FIG. 1, electrical connector 10 includes a central body 20, and a switch subassembly 30 for being received within body 20. Electrical connector 10 further includes wire terminating electrical contacts comprising IDC contacts 40 for termination with a central office side telecommunications circuit. In addition, electrical contact 10 includes wire terminating electrical contacts comprising IDC contacts 50 on an opposed side of body 20 for termination with a subscriber side telecommunications circuit. Additionally, wire terminating members comprising discriminators 60,70,80 are slidingly fit over portions of body 20 and respective contact blades 40,50. End caps 90,95 are secured on distal end portions of body 20 for holding respective discriminators 60,70,80 in place. Wires (not shown) are to be inserted in and terminated by discriminators 60,70,80. As will be further described below, switch assembly 30 is operative to switch from: a normal mode, whereby the central office side circuit will be in communication with the subscriber side circuit; to a test mode, whereby the central office side circuit will be disconnected from the subscriber side circuit and the subscriber side wires will be commoned.

Figure 2:
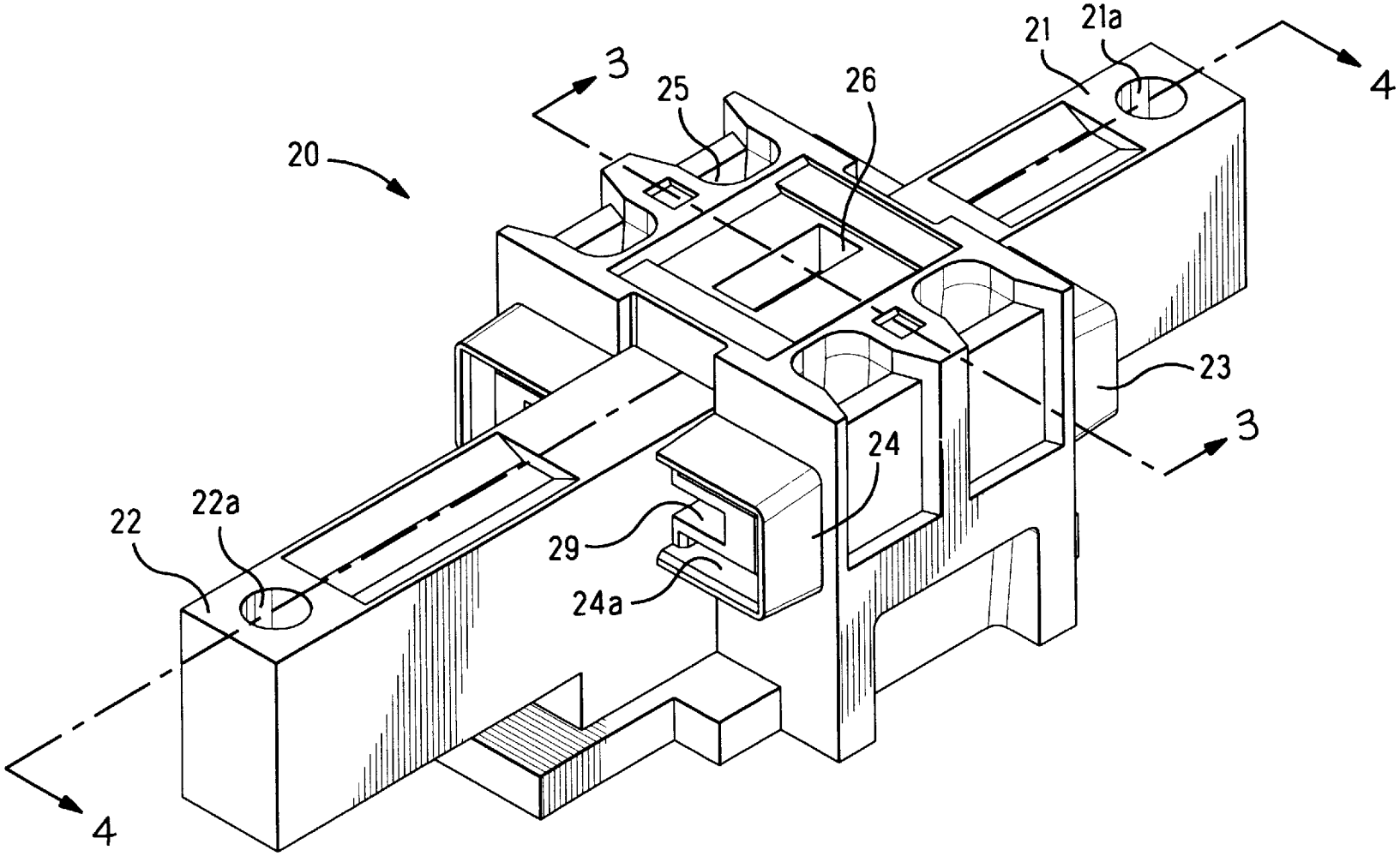
FIG. 2 shows an isometric view of the body member of the electrical connector of FIG. 1.
Figure 4:
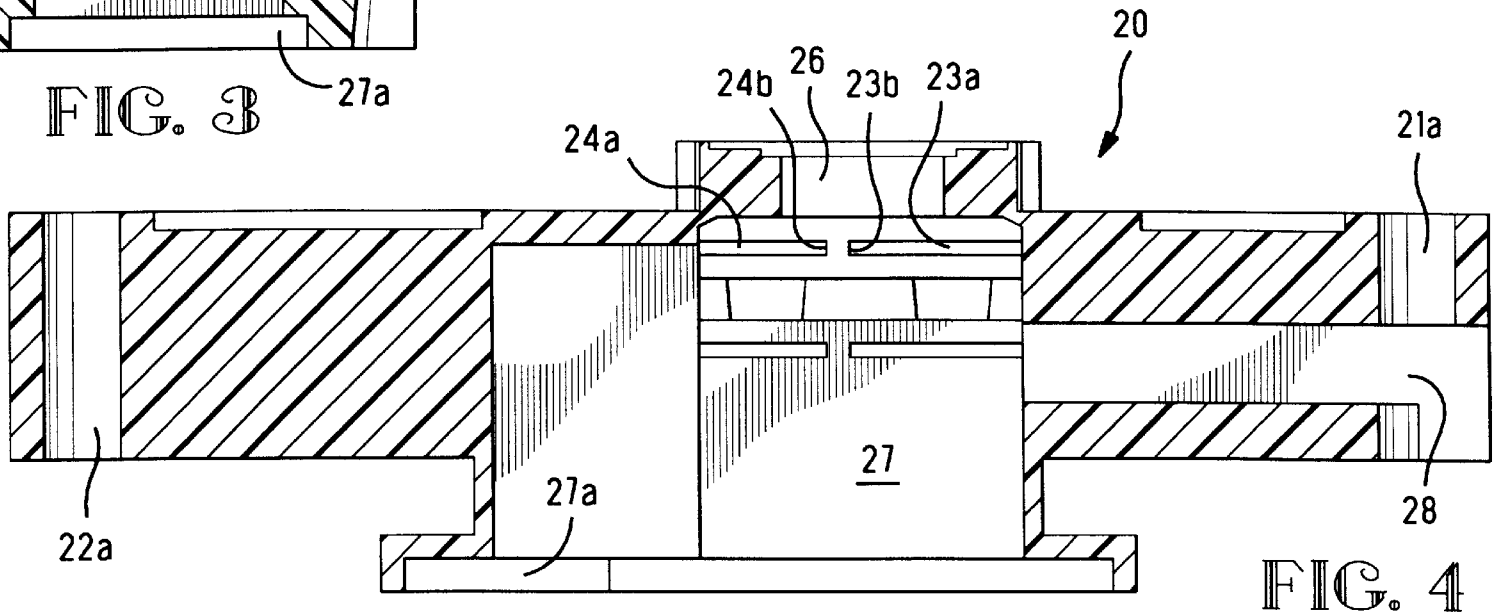
FIG. 4 shows a longitudinal cross section of the body of FIG. 2 taken along line 4—4.

As is best shown in FIGS. 1 and 2, body 20 further includes a central office side rail 21 having a fastener hole 21*a*, and a subscriber side rail 22 with a fastener hole 22*a*. Body 20 comprises contact receiving projections 23,24 each having respective IDC contact receiving passageways 23*a*, 24*a* formed therein. As best shown in FIG. 4, contact receiving passageways 23*a*,24*a* each include a stop section 23*b*,24*b* within cavity 27. The top face of body 20 includes a plurality of test ports 25 for receiving circuit test probes (not shown), and body 20 also includes a button receiving hole 26.

Figure 3:
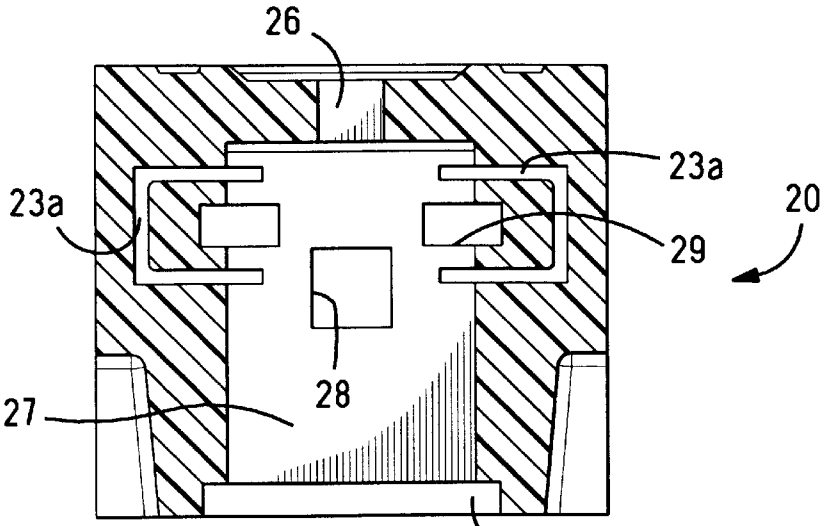
FIG. 3 shows a transverse cross sectional view of the body of FIG. 2 taken along line 3—3.

As is best shown in FIGS. 3–4, body 20 also includes a cavity 27 for receiving switch assembly 30. Cavity 27 includes a plate recess 27*a*, and a feeder conduit 28 for receiving an insulative gel material therein, for example, a silicone-based gel material (not shown). As shown in FIG. 3, conduit 28 is in communication with an exterior surface of body 20, cavity 27, and channels 29 of body 20, for allowing the gel to flow through conduit 28 to cavity 27 and channels 29.

Figure 11:
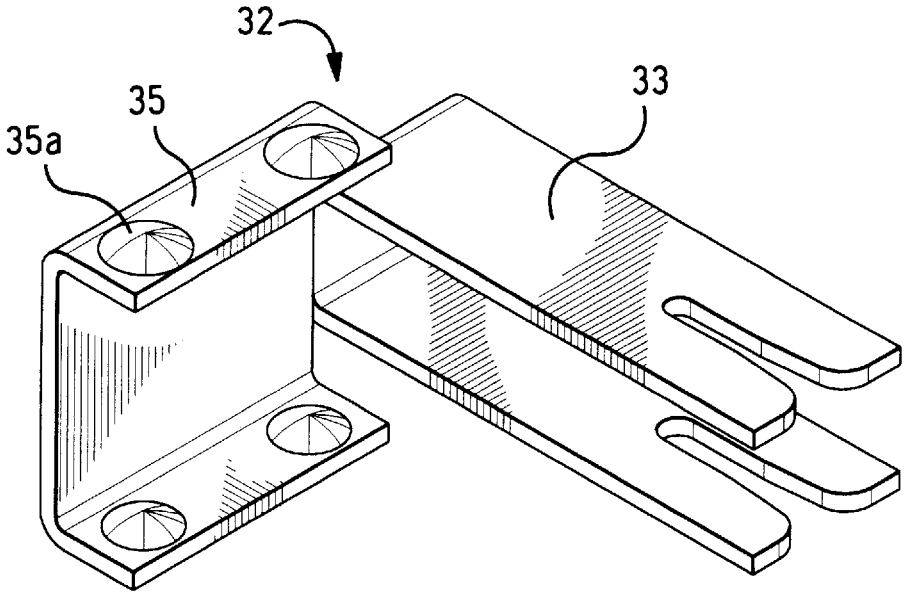
FIG. 11 shows an isometric view of an electrical contact used with the switch subassembly of FIG. 1.
Figure 12:
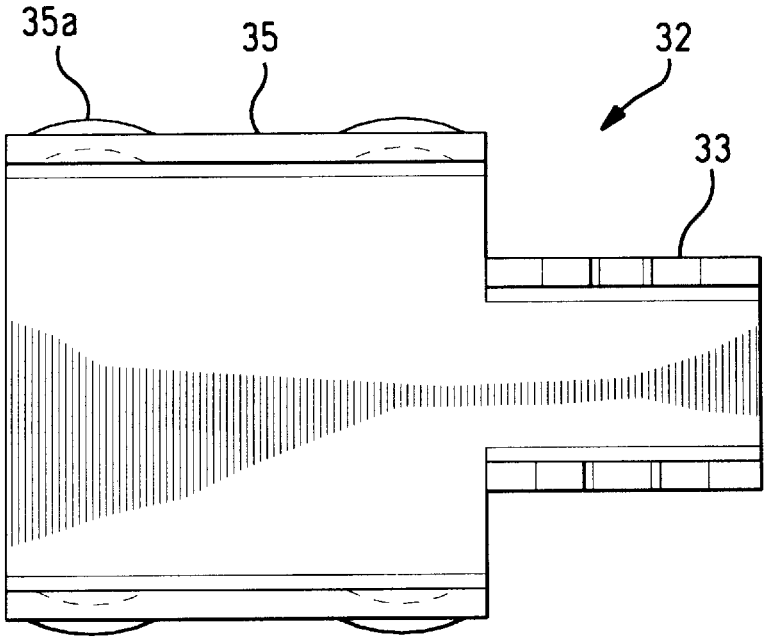
FIG. 12 shows a side view of the electrical contact of FIG. 11.
Figure 14:
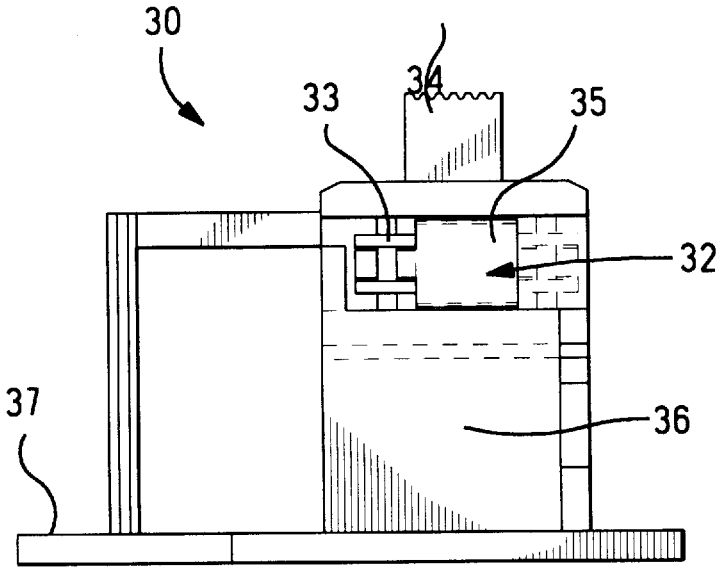
FIG. 14 shows the contact of FIG. 11 installed on the switch subassembly of FIG. 1.
Figure 16:
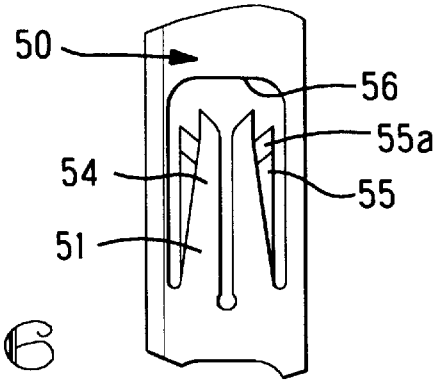
FIGS. 15 and 16 show opposed views of the IDC sections of the contact blades of FIGS. 1 and 9.
Figure 15:
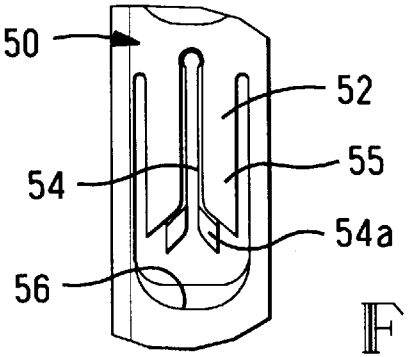

Now referring to FIGS. 11, 12, and 14, switch assembly 30 will be further described. Switch assembly 30 includes electrical contacts 32 each comprising sliding interfaces 35 having low-friction surfaces 35*a*. Contacts 32 also include IDC contact sections 33 for termination with leads extending from an electrical dummy-load (not shown), for example, a conventional resisitive-capacitive test component. Switch assembly 30 also includes an operator button 34, a cavity 36 for receiving the electrical dummy-load, and a cover plate 37.

Figure 5:
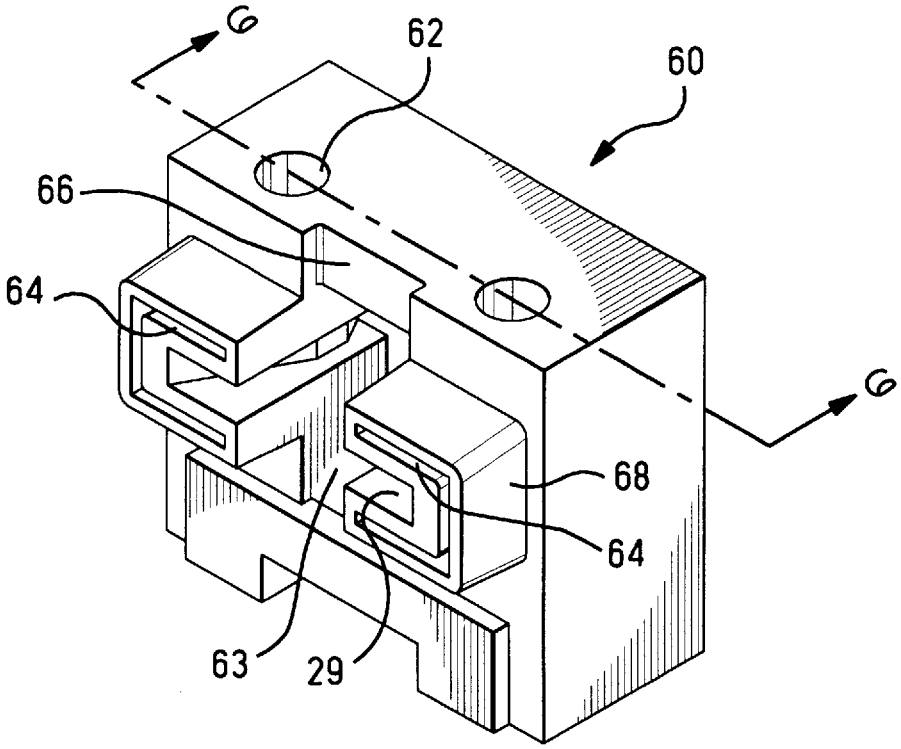
FIG. 5 shows an isometric view of a discriminator member of FIG. 1.
Figure 6:
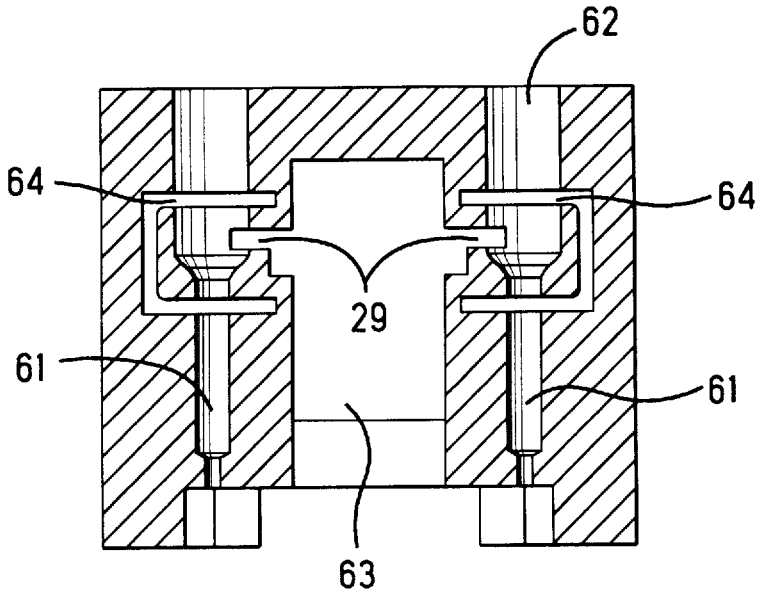
FIG. 6 shows a cross sectional view of the discriminator of FIG. 5 taken along line 6—6.

Referring now to FIGS. 1, 5, and 6, discriminators 60,70, 80, which are typical with respect to each other in structure and function, will be described. Discriminators 60,70,80 respectively include: a pair of small gauge wire holes, e.g. hole 61 shown in FIG. 6; a pair of large gauge wire holes 62,72,82; a rail receiving aperture 63,73,83; a pair of contact receiving passageways 64,74,84; a pair of projection receiving cavities, e.g. projection receiving cavity 65 shown in FIG. 6; a tool receiving recess 66,76,86; and projections 68,78,88. Each discriminator 60,70,80 also includes a continuation of gel conduit 29 which is in communication with respective holes 62,72,82 and passageways 64,74,84.

Figure 7:
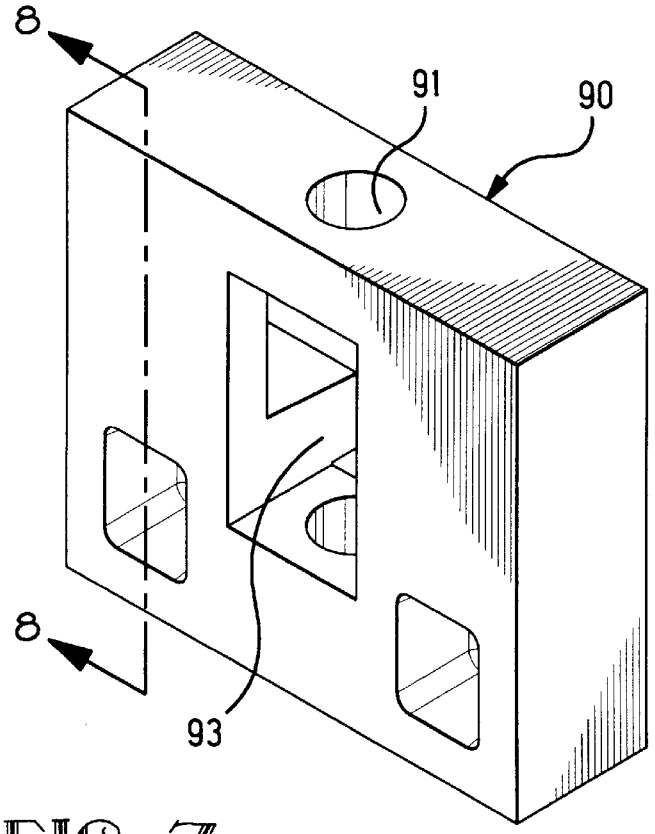
FIG. 7 an isometric view of an end cap of the connector of FIG. 1.
Figure 8:
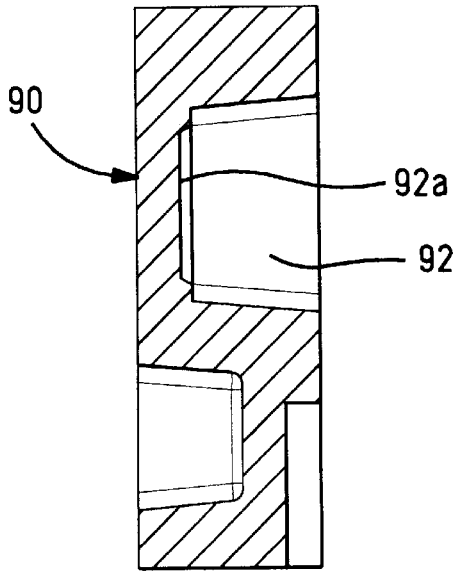
FIG. 8 shows a cross sectional view of the end cap of FIG. 7.
Figure 9:
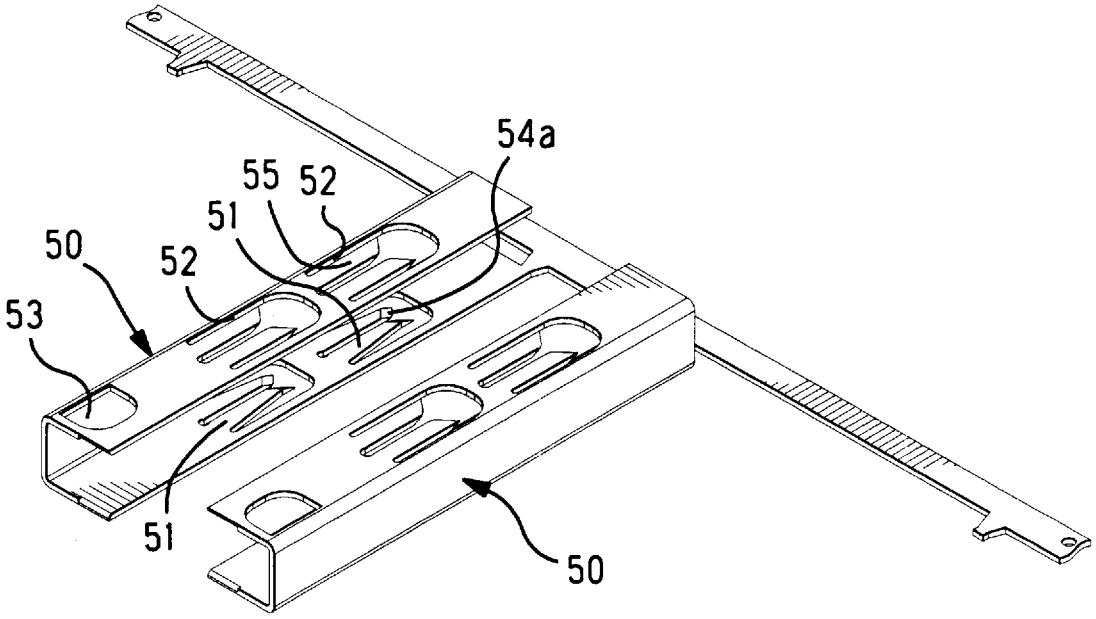
FIG. 9 shows an isometric view of a pair of IDC contacts of the electrical connector of FIG. 1 connected to a carrier strip.
Figure 10:
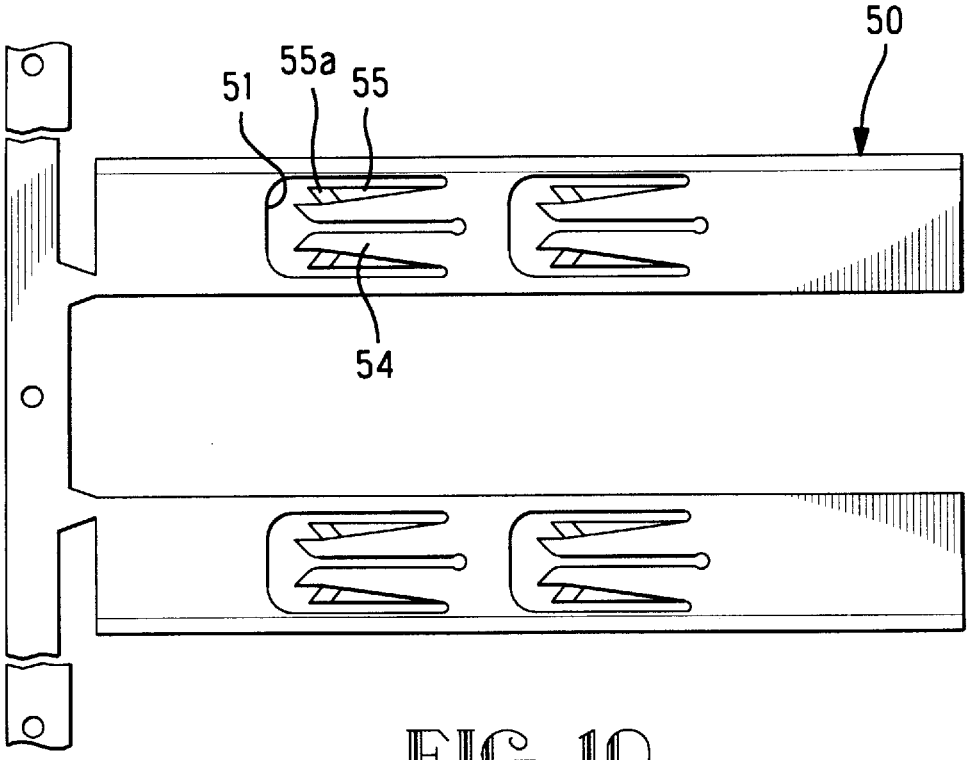
FIG. 10 shows a bottom view of the IDC contacts of FIG. 9.

Referring to FIGS. 1, 7, and 8, end caps 90,95 are substantially the same, so that end cap 95 is typical of end cap 90 in structure and function. Each end cap 90,95 includes, respectively a screw hole 91,96 for receiving a fastener therein; and projection receiving recesses 92,97 having stabilizing tapered sections, e.g. tapered section 92*a* shown in FIG. 8. Additionally, each end cap 90,95 includes a respective rail receiving aperture 93,98.

Referring to FIGS. 9, 10, 15, and 16, IDC contacts 40,50 will be further described. IDC contacts 50 each include respective small gauge IDC blade sections 51 having blades 54, large gauge IDC blade sections 52 having blades 55, and a test probe aperture 53. Blades 54,55 each include respective sharpened tapers 54*a*,55*a* at ends thereof which are spaced from respective edges 56. Blades 55, which comprise a relatively greater cross sectional area than blades 54, are flexuraly more robust than blades 54 for terminating large gauge wires. As shown in FIG. 1, IDC contacts 40 include small gauge IDC blade sections 41 having blades 44, large gauge IDC blade sections 42 having blades 45, respective gel test robe apertures 43, and edges 46. IDC contacts 40 are, therefore, typical of IDC contacts 50 in structure and function; however, IDC contacts 50 include a further set of blades. In an advantage of the present invention, IDC blade sections 41,42 and 51,52 are in a superimposed relationship with respect to each other because of a generally U-shaped cross section of IDC contact 40,50. Sharpened tapers of blades 44,45 and 54,55 are offset relative to each other along respective longitudinal axes of IDC contacts 40,50 for receiving wires of differing nominal sizes.

Figure 13:
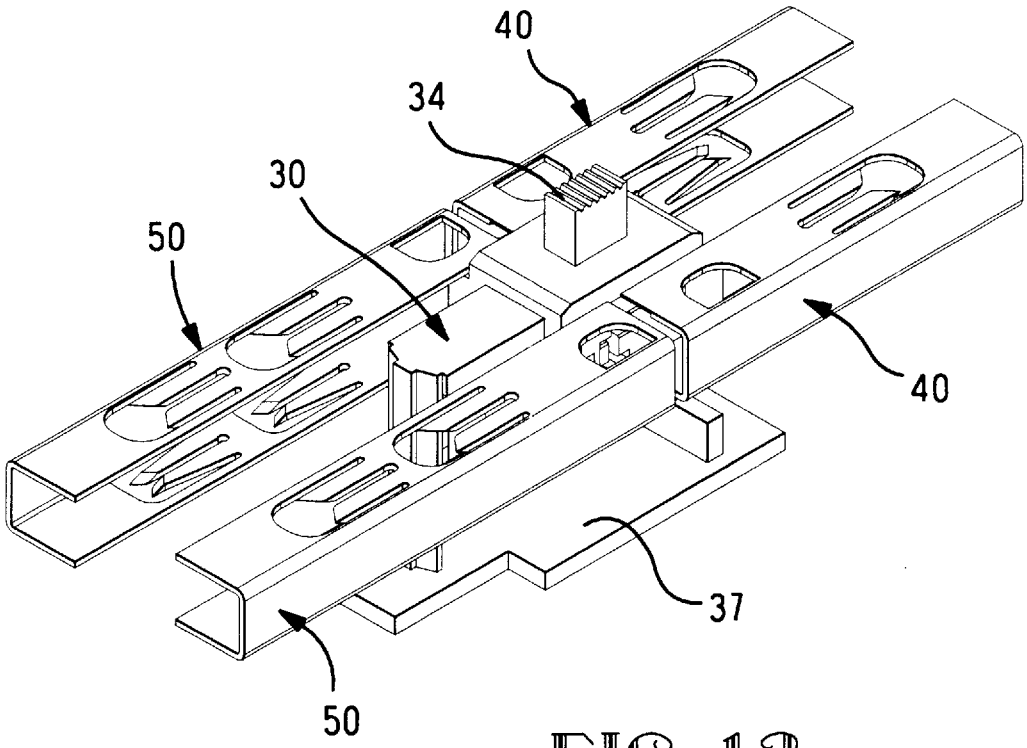
FIG. 13 shows an isometric view of the switch subassembly of FIG. 1 as it interengages the contact blades of FIGS. 1, 9, and 10.

Referring to the forgoing, a preferred assembly operation of the invention will now be described. First, a switch assembly with a suitable conventional electrical dummy-load terminated to IDC sections 33 of contacts 32 is provided. Then switch assembly 30 is aligned with body 20 so that operator button 34 is centered with respect to button hole 26, as shown in FIG. 1. Switch assembly 30 is then inserted into cavity 27. Next, IDC contacts 40,50 are aligned with and inserted into respective passageways 24*a*,23*a*. As this occurs, IDC contacts 40,50 will slide over and electrically interengage contacts 32 of switch subassembly 30. The U-shaped structure of IDC contacts 40,50 slide over respective sliding contact portions 35 of contacts 32, thereby interengaging IDC contacts 40,50 with contacts 32. IDC contacts 40,50 are inserted into body 20 until the respective ends thereof extend into cavity 27 and engage respective stops 23*b*,24*b* of passageways 23*a*,24*a*. At this point in the assembly operation, switch subassembly 30 is movably mounted in cavity 27 and is slidably interengaged with IDC contacts 40,50, for example, as shown in FIG. 13 (without body 20). The interengagement of IDC contacts 40,50 with contacts 32 functions as a guiding track for switch assembly 30. Additionally, test probe apertures 43,53 of IDC contacts 40,50 will be aligned with test probe ports 25 of body 20. Also, plate section 37 will cover the opening of cavity 27.

Next, discriminator 60 is movably mounted to rail 21 and IDC contacts 40, i.e. rail 21 is inserted into aperture 63 and IDC contacts 40 pass through respective passageways 64. Then, discriminators 70,80 are movably mounted to rail 22 and IDC contacts 50 so that rail 22 is inserted into apertures 73 and 83 (FIG. 17), and IDC contacts 50 pass through respective passageways 74,84. End caps 90,95 are then mounted to respective ends of rails 21,22, with fasteners (not shown) to be inserted through respective holes 91,96 and screwed into respective holes 21*a*,22*a* of rails 21,22.

At this point, the tapered stabilizing sections of end caps 90,95 abut the distal ends of respective IDC contacts 40,50, e.g. tapered stabilizing section 92*a* of FIG. 8 which is typical of the like formed on end cap 95. IDC contacts 40,50 are thus fixed between end caps 90,95 and stops 23*b*,24*b* of body 20. A sealing gel material is then injected into conduit 28, the gel flows into cavity 27 for sealing switch assembly 30 and contacts 32, and the gel flows into channels 29 and each discriminator 60,70,80 thereby coating IDC contacts 40,50. The gel thereby advantageously seals contacts 32 and IDC contacts 40,50 from moisture thereby making electrical connector 10 protected from the environment and suitable for use in indoor or outdoor enclosures.

Referring to the foregoing, operation of electrical connector 10 will be described. Small or large gauge wires of the central office side circuit, because blades sections 41,42 are superimposed, can be terminated in holes 62 of discriminator 60. Small gauge wires will be inserted into hole 62, and extend past IDC section 42 between edge 46 and blades 45, and will extend into relatively smaller hole 61. Large gauge wires, however, because of the offset relationship between the ends of blades 44,45, can be inserted into hole 62 only, as ends of the wires will abut blades 44 and are thereby prevented from insertion past blades 44 into smaller hole 61. Next, a tool, for example a flat head screw driver, is lodged in tool recess 66 between discriminator 60 and end cap 90. The screwdriver is then twisted or pried to force discriminator 60 toward body 20. As this occurs, small gauge wires disposed in holes 61 and 62 will move with discriminator 60, and therefore will be forced into terminating engagement with blades 44 and 45 thereby making swift, reliable electrical connections; however, very small gauge wires may only be engaged by blades 45 and not electrically terminated with them. Large gauge wires disposed in holes 62 will be forced into terminating engagement with blades 45. Thus the superimposed and longitudinally offset relationship of blade sections 41,42 advantageously permits termination of IDC contacts 40 with small or large gauge wires without separate wire adapters.

Additionally, IDC contacts 40 will be protected in the pretermination condition because they are covered by projections 23, discriminator 60, and end cap 90. As the wires are terminated, discriminator 60 will be advanced toward body 20, and projections 68 will be moved out of projection receiving cavities 93 of end cap 90. In the terminated condition, projections 68 thereby cover IDC contacts 40 along with discriminator 60 and end cap 90. IDC contacts 40 are thus covered and protected from the environment in either of the preterminated or terminated conditions of the wires thereby making electrical connector 10 suitable for use in indoor or outdoor enclosures.

Next, because blades sections 51,52 are superimposed, small or large gauge wires of the subscriber side can be terminated in holes 72,82 of discriminators 70,80, which discriminators are typical of discriminator 60. Small gauge wires inserted into holes 72 or 82 extend past IDC sections 52 and blades 55 into a relatively smaller hole, e.g. substantially like holes 61 of FIG. 6. Large gauge wires, however, because of the offset relationship between the ends of blades 54,55, can be inserted into larger holes 72,82 only, as ends of the wires will abut blades 54 and are thereby prevented from insertion past blades 54 into the smaller holes. Next, a tool, for example a flat head screw driver, is lodged in tool recess 76 between discriminator 70 and discriminator 80. The screwdriver is then twisted or pried to force discriminator 70 toward body 20. As this occurs, small gauge wires disposed in the small holes and large holes 72,82 will be forced into engagement with blades 54 and 55 thereby making swift, reliable electrical connections; however, very small gauge wires may only be engaged by blades 55 and not electrically terminated with them. Large gauge wires disposed in holes 72 only will be forced into engagement with blades 55. Thus, the superimposed and longitudinally offset relationship of ends of blade sections 51,52 advantageously permits termination of IDC contacts 50 with both small or large gauge wires of the subscriber side circuit wires without separate wire adapters. In a like manner, a tool is used to force discriminator 80 toward body 20 for termination with large or small gauge wires inserted therein.

IDC contacts 50 will be protected in the pretermination state because projections 23, discriminators 70,80, and end cap 95 cover them. After termination of the wires in discriminator 70, projections 78 thereof will be out of projection receiving cavities of discriminator 80 and will cover IDC contacts 50 along with discriminators 70,80 and end cap 95. After termination of the wires in discriminator 80, projections 88 thereof will be will be moved of projection receiving cavities of end cap 95, and projections 78 of discriminator 70 will de disposed in a projection receiving recess of discriminator 80. IDC contacts 50 will then be protected by discriminator 70 and 80, projections 83, and end cap 95. IDC contacts 50 are thus covered and protected from the environment in either of the preterminated or terminated conditions of the wires thereby making electrical connector 10 suitable for use in indoor or outdoor enclosures.

The function of switch subassembly 30 is to switch the electrical dummy-load into and out of normal and test modes with respect to the central office and subscriber sides of electrical connector 10. Generally during use, switch subassembly 30 will be in the normal mode position in the overall telecommunications circuit, i.e. there will be electrical continuity from the central office side wires of the circuit to IDC contacts 40, from IDC contacts 40 into respective contacts 32, from contacts 32 to respective IDC contacts 50, and then to the subscriber side wires. However, when it is desired to test the subscriber side circuit, switch subassembly 30 is switched into a test mode simply by moving button 34 toward the subscriber side circuit of body 20 without the need to disconnect wires from the electrical connector. As this occurs, contacts 32 will be moved out of interengagement with IDC contacts 40 but will remain in interengaging contact with IDC contacts 50. The electrical dummy-load is thus electrically interposed between the wires of the subscriber side circuit. To test the circuits, an operator places a test probe in any of test probe ports 25 and electrically contacts IDC contacts 40 or 50 via respective test probe apertures 43,53.

Figure 17:
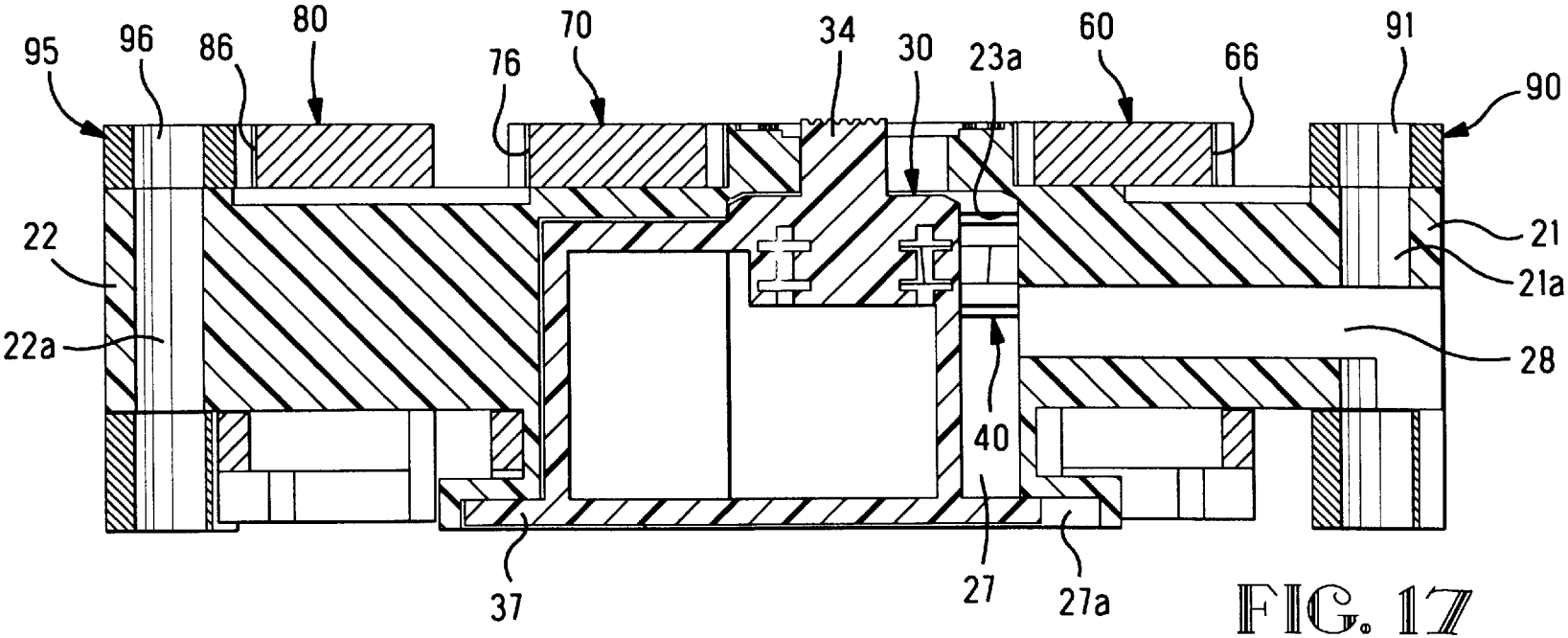
FIG. 17 shows a longitudinal cross section of the connector of FIG. 1 in an assembled state.

In another advantage of the invention, low friction surfaces 35*a* of contact pairs 32 are advantageously shaped to maintain contact normal forces, and to reduce the sliding friction between, contacts 32 and IDC contacts 40,50 as switch subassembly 30 is switched between normal and test positions. Moreover, because contacts 32 are slidably interengaged with blades 40,50, switch subassembly 30 is advantageously slidably supported within cavity 27 between the normal and test mode positions, thereby obviating the need for other support means. Additionally, as is best shown in FIG. 17, plate 37 slidably covers plate recess 27*a* of cavity 27 in either of the test or normal mode positions of switch subassembly 30, thus cavity 27 is protected from the ingress of foreign objects or contaminants.

In view of the foregoing, the present invention is an electrical connector 10 that comprises a switching assembly 30 for testing a subscriber side circuit without the need to disconnect wires from the electrical connector. In addition, electrical connector 10 is suitable for use in telecommunications circuits and permits swift, reliable electrical connections, and is robust enough for use in indoor or outdoor enclosures. Moreover, electrical connector 10 can accommodate small or large gauge wires without separate wire adapters.

Figure 18:
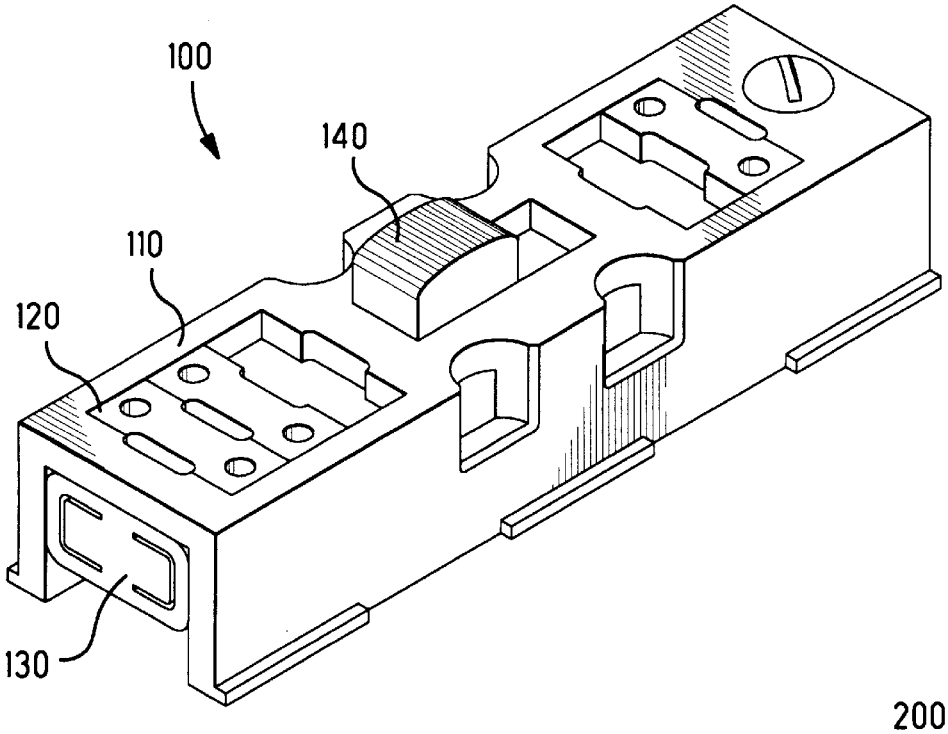
FIG. 18 shows an isometric view of second embodiment of the present invention.
Figure 19:
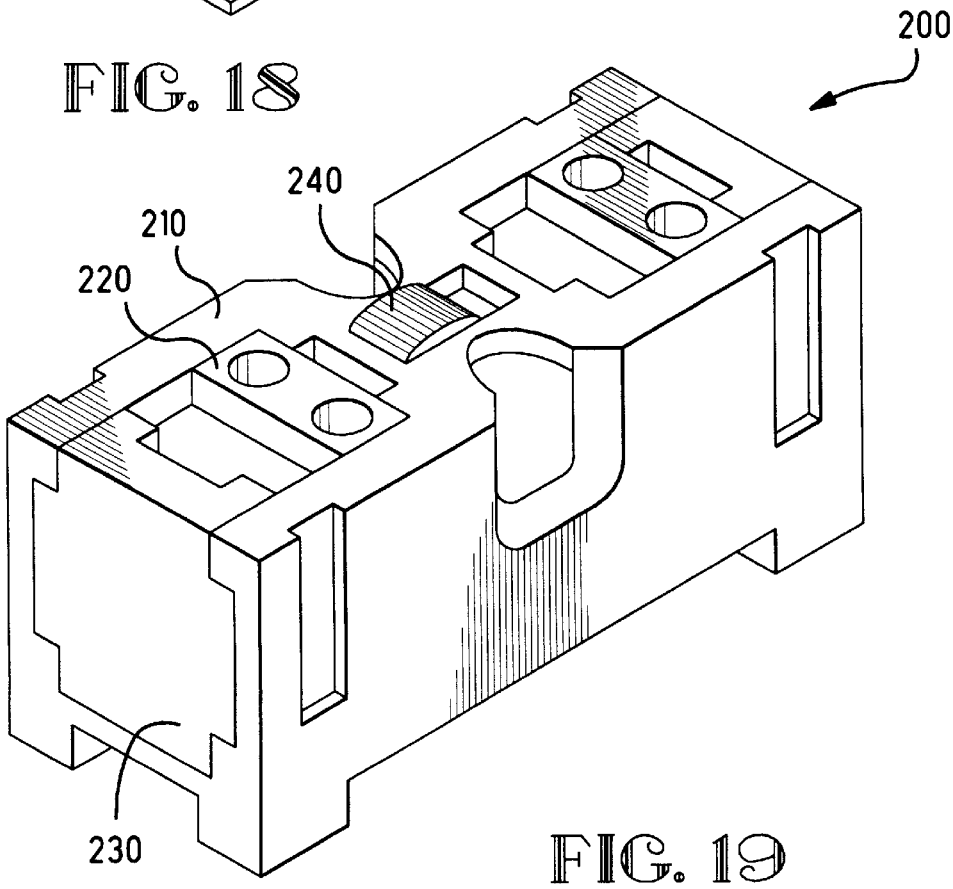
FIG. 19 shows an isometric view of a third embodiment of the present invention.

Now referring to FIGS. 18 and 19, second and third embodiments of the present invention will be described; however, it is understood that the concepts and advantages of the foregoing description in respect of the foregoing embodiment apply equally to the features and advantages of the embodiments of FIGS. 18 and 19. FIG. 18 shows a second embodiment of the present invention comprising a connector 100 which includes: an outer housing 110; discriminators 120 slidably connected to rail 130; and a switch button 140. Connector 100 functions substantially the same as the foregoing description with respect to connector 10. However, outer housing 110 has been added to further protect discriminators 120 and the body of connector 100, and to provide a connection means to a DIN rail. FIG. 19 shows a third embodiment of the present invention comprising an electrical connector 200 having: an outer housing 210; discriminators 220; and end caps 250. Discriminators 220 are slidably movable on a rail and, as in the foregoing embodiments, end caps 250 are provided to delimit their motion on the rail.

Thus, while preferred embodiments of the invention have been disclosed, it is to be understood that the invention is not strictly limited to such embodiments but may be otherwise variously embodied and practiced within the scope of the appended claims.

What is claimed is:

1. An electrical connector for use in testing an electrical circuit comprising a body, the body including a cavity, a switch assembly therein, and wire terminating electrical contacts, the switch assembly comprises at least one electrical contact having a sliding contact section which is interengageably received by a portion of at least one of the wire terminating electrical contact so that the switch assembly is thereby slidably supported in the cavity as the switch assembly is moved between normal and test modes of the circuit, wherein the body includes contact receiving projections that cooperate with projection receiving cavities formed on a set of wire terminating members of said electrical connector for protecting the wire terminating electrical contacts of the electrical connector from exposure to the environment and foreign objects, and wherein the body includes contact receiving passageways, and wire terminating members include respective complementary contact receiving passageways for receiving the wire terminating electrical contacts, the passageways protect the wire terminating electrical contacts from exposure to the environment and foreign objects.

2. The electrical connector of claim 1, wherein the switch assembly comprises at least two electrical contacts for being interengageably received by respective ones of the wire terminating electrical contacts for slidably supporting the switch assembly in the cavity.

3. The electrical connector of claim 1, wherein the switch assembly comprises an electrical dummy-load receiving cavity therein.

4. The electrical connector of claim 1, wherein wire terminating electrical contacts comprise wire termination sections that are arranged in a superimposed relationship with respect to each other for terminating wires of different nominal sizes.

5. The electrical connector of claim 1, wherein the body comprises rails that movably receive a respective set of terminating members thereon.

6. The electrical connector of claim 1, wherein the electrical connector comprises terminating members which are operative to receive and move respective ones of the wires into electrical engagement with a set of wire terminating electrical contacts.

7. An electrical connector for use in testing an electrical circuit comprising a body, the body including a cavity and contact receiving passageways communicating with the cavity; a switch assembly positioned in the cavity; wire terminating electrical contacts, the switch assembly including a sliding contact section for engaging a portion of at least one wire terminating contact and being moved between normal and test modes of the circuit; and wire terminating members including complementary contact receiving passageways, the wire terminating members being operative to move wires into electrical engagement with the wire terminating electrical contacts; the wire terminating contacts being received within contact receiving passageways on the body and on the wire terminating members to protect the wire terminating electrical contacts from exposure to the environment and foreign objects;

wherein the body includes contact receiving projections that cooperate with projection receiving cavities formed on the wire terminating members for protecting the wire terminating electrical contacts from exposure to the environment and foreign objects.

8. The electrical connector of claim 7 wherein the electrical contact sliding section slidably supports the switch assembly in the cavity.

9. An electrical connector for use in connecting a central office side of a telecommunications circuit to a subscriber side telecommunications circuit in a wiring enclosure and for disconnecting the central office side circuit from the subscriber side for testing, the electrical connector comprising:

a body having a subscriber side and a central office side;

subscriber side IDC contacts located on the subscriber side of the body for terminating twisted pair wires;

central office side IDC contacts located on the central office side of the body for terminating twisted pair wires, longitudinal axes of each central office side IDC contact being aligned with longitudinal axes of a corresponding subscriber side IDC contact;

wire terminating members shiftable relative to the IDC contacts for inserting wires into engagement with the IDC contacts; and slidable switch contacts mounted in the body and shiftable along the longitudinal axis of the central office side IDC contacts and the longitudinal axis of the subscriber side IDC contacts from a normal mode in engagement with the subscriber side IDC contacts and a test mode in which the switch contact is disengaged from the subscriber side IDC contact, the subscriber side IDC contacts and the central office side IDC contacts forming a guiding track for slidably supporting the switch contacts.

10. The electrical connector of claim 9 wherein the wire terminating members are shiftable along the longitudinal axes of the central office side IDC contacts and of the subscriber side IDC contacts for inserting wires into engagement with the IDC contacts.

11. The electrical connector of claim 9 including rails extending from the central office side and the subscriber side of the body, with the central office side IDC contacts and the subscriber side IDC contacts supported by the rails.

12. The electrical connector of claim 11 wherein the wire terminating members are supported by the rails.

13. The electrical connector of claim 9 wherein each wire terminating member surrounds a corresponding rail and a corresponding IDC contact.

14. The electrical connector of claim 9 wherein each wire terminating member is shiftable toward the body to insert wires into engagement with corresponding IDC contacts.

15. The electrical connector of claim 9 wherein a gel is located in the body and in surrounding relationship to the IDC contacts to protect the IDC contacts from exposure to the environment.

16. The electrical connector of claim 9 wherein the central office side IDC contacts and the subscriber side IDC contacts each comprise U-shaped members with wire terminating sections superimposed with respect to each other for terminating wires of different nominal sizes.

17. The electrical connector of claim 9 wherein the subscriber side IDC contact includes multiple wire terminating sections for terminating multiple subscriber side wires to central office side wires.

* * * * *